United States Patent [19]

Ylönen et al.

[11] Patent Number: 4,548,164

[45] Date of Patent: Oct. 22, 1985

[54] ENGINE DRIVEN GENERATOR ASSEMBLY

[75] Inventors: Paavo Ylönen; Urpo Hirvikoski, both of Nokia; Esa Piippo, Mouhijärvi; Pentti Rajala, Linnavuori, all of Finland

[73] Assignee: Valmet OY, Finland

[21] Appl. No.: 696,094

[22] Filed: Jan. 29, 1985

[30] Foreign Application Priority Data

Feb. 9, 1984 [FI] Finland ..... 840537

[51] Int. Cl.[4] ..... F02B 63/04

[52] U.S. Cl. ..... 123/2; 123/195 C; 123/198 E; 290/1 A; 290/1 B

[58] Field of Search ..... 123/2, 198 E, 195 C; 290/1 R, 1 A, 1 B, 1 C, 1 D

[56] References Cited

U.S. PATENT DOCUMENTS

| | | | |
|---|---|---|---|
| 1,343,485 | 6/1920 | Shamberg | 290/1 A |
| 2,019,026 | 10/1935 | Spear et al. | 290/1 B |
| 2,086,036 | 7/1937 | Juergens | 123/198 E |
| 2,123,358 | 7/1938 | Grutzner | 123/198 E |
| 2,177,687 | 10/1939 | Bracken et al. | 290/1 A |
| 2,355,208 | 8/1944 | Devol et al. | 290/1 B |
| 2,633,118 | 3/1953 | Ahman | 123/198 E |
| 4,122,353 | 10/1978 | Noguchi | 290/1 A |
| 4,226,214 | 10/1980 | Palazezzi | 123/2 |

FOREIGN PATENT DOCUMENTS

| | | | |
|---|---|---|---|
| 2901632 | 7/1980 | Fed. Rep. of Germany | 123/2 |
| 197416 | 11/1983 | Japan | 123/2 |

*Primary Examiner*—Ira S. Lazarus

*Attorney, Agent, or Firm*—Steinberg & Raskin

[57] ABSTRACT

An engine driven generator assembly comprises an internal combustion engine, e.g. a diesel engine and a generator driven by the engine, the engine and generator being mounted in a thermally and acoustically insulated housing provided with ports for cooling intake air and exhaust air and an aperture for an exhaust pipe. The engine is mounted in the housing substantially vertically over the generator, the engine having a substantially horizontal crankshaft which is situated substantially in the same vertical plane in which a substantially horizontal generator shaft is situated. A fuel tank for the engine is provided which constitutes at least a part of a wall of the housing to provide lateral stiffening reinforcement therefore. The ports for cooling intake air and exhaust air as well as the aperture for the exhaust pipe are provided in a common housing wall with the intake air port situated below the exhaust air port which in turn is situated below the aperture for receiving the exhaust pipe. A ventilation module is mounted on the common housing wall in which the air ports and exhaust pipe aperture are provided, the ventilation module including apertures formed therein through which intake and exhaust air are adapted to pass. Louvers are provided in the ventilation module for opening and closing the apertures and a fitting is provided for connection to the exhaust pipe received in the exhaust pipe aperture. This construction provides a compact, space efficient assembly by which the noise generated during operation is significantly reduced.

14 Claims, 11 Drawing Figures

ENGINE DRIVEN GENERATOR ASSEMBLY

BACKGROUND OF THE INVENTION

The present invention relates to internal combustion engine driven generator assemblies and, more particularly, to such assemblies which include a generator driven by an internal combustion engine, such as a diesel engine, devices for controlling and monitoring operation of the engine and generator, and wherein the engine and generator are situated in a thermally and acoustically insulated housing provided with ports for cooling intake and exhaust air and an aperture for an exhaust pipe.

The present invention will be described below with reference to an embodiment wherein the generator is driven by a diesel engine.

Diesel engine powered generator assemblies which are situated indoors, such as in factories and the like, are generally arranged with the engine and generator mounted on a unitary base plate laterally adjacent to each other on the same level. Power transmission from the engine to the generator is usually provided in the form of an elastic coupling and, if required, speed reduction gears. An elastic coupling is required due to the vibration of the diesel engine during operation. Reduction gears are generally needed when the generator comprises a four-pole machine which requires the rotor to rotate at a speed of about 1,500 rpm since the speed of rotation of the diesel engine is usually higher. A cardan shaft may also be used to transmit power between the diesel engine and the generator.

Although an assembly having a construction of the type described above is not very wide, its length is relatively large and, therefore, conventional engine driven generator assemblies require significant floor space.

The noise level accompanying operation of a generator assembly wherein the engine and generator are not enclosed within an acoustically insulated housing is very high, usually approaching 100 dB. In conventional arrangements the noise generated by the exhaust gas can be suppressed by means of a silencer suspended from the ceiling which requires special piping and suspension members. The fuel tank for the engine is generally provided as a unit which is separate from the assembly requiring installation of separate fuel conduits and the like.

The in-line placement of the engine and generator further requires two separate air conditioning ports in the engine room, one for the intake air and one for the exhaust air.

An engine driven generator assembly as described above may be enclosed in a housing provided with heat and sound insulation. In such a case, however, the dimensions of the assembly are even greater than in the case described above and the required floor area correspondingly increases. Moreover, an enclosed assembly of this type necessitates the provision of two air conditioning ports in the engine room in which the assembly is located.

SUMMARY OF THE INVENTION

It is the main object of the present invention to provide a new and improved engine driven generator assembly and which, in particular, provides both constructional and operational improvements with respect to conventional assemblies.

Briefly, in accordance with the present invention, this object as well as others are attained by providing an engine driven generator assembly wherein:

(a) the engine and generator are mounted in a thermally and acoustically insulated housing with the engine being mounted vertically over the generator and wherein the engine crankshaft from which power is transmitted to the generator, and the generator shaft, are substantially horizontal and are located substantially in the same vertical plane, (b) the thermally and acoustically insulated housing includes a substantially rigid frame to which insulation elements constituting walls of the housing are attached and from which the engine and generator are suspended, (c) a fuel tank for the engine constitutes at least a part of a wall of the housing for providing lateral stiffening reinforcement therefor, (d) an intake air port, an exhaust air port and an aperture adapted to receive an exhaust pipe are all provided in a common housing wall with the exhaust pipe aperture being situated above the exhaust air port which in turn is situated above the intake air port, and (e) a ventilation module is provided which is adapted to be mounted on the common housing wall in which the air ports and exhaust pipe aperture are formed, the ventilation module having apertures formed therein through which intake and exhaust air are adapted to pass louvers being provided for opening and closing the apertures, and a fitting for connection to an exhaust pipe mounted in the exhaust pipe aperture of the housing.

In accordance with another feature of the invention, the ventilation module is provided with means for automatically selectively directing the circulation of exhaust air either directly through the exhaust air aperture of the ventilation module or to the intake air port of the housing depending upon the operating temperature of the engine.

An important advantage of the invention is that by virtue of the particular manner in which the engine and generator are mounted with the engine situated vertically above the generator, the width and height of the enclosed assembly including associated ventilation module are smaller than the corresponding dimensions of a conventional fireproof door typically used in buildings of the type in which such assemblies are used so that the engine driven generator assembly and ventilation module are capable of fitting within the fireproof door.

An assembly constructed in accordance with the present invention has several other important advantages which cannot be achieved by assemblies of conventional construction. By positioning the engine and generator with respect to each other in the manner described above, a remarkably compact, space efficient assembly is obtained in which all of the ventilation apertures are situated on the same side of the housing thereby enabling the use of a prefabricated ventilation module equipped with connections for all of the ventilation ports. By arranging the engine and generator vertically over each other it also becomes possible to utilize less complicated power transmission means without requiring expensive reduction gears. By virtue of the structural design of the fuel tank and its use as at least a part of a wall of the housing, the housing frame is provided with sufficient lateral rigidity so as to eliminate the necessity for additional cross brace type reinforcements.

DETAILED DESCRIPTION OF THE DRAWINGS

A more complete appreciation of the present invention and many of the attendant advantages thereof will be readily understood by reference to the following detailed description when considered in connection with the accompanying drawings in which:

FIG. 1A is a side elevation view of an engine driven generator assembly of conventional design of the type used indoors, such as in an engine room of a factory or the like;

DESCRIPTION OF THE PREFERRED EMBODIMENTS

Figure 1A:
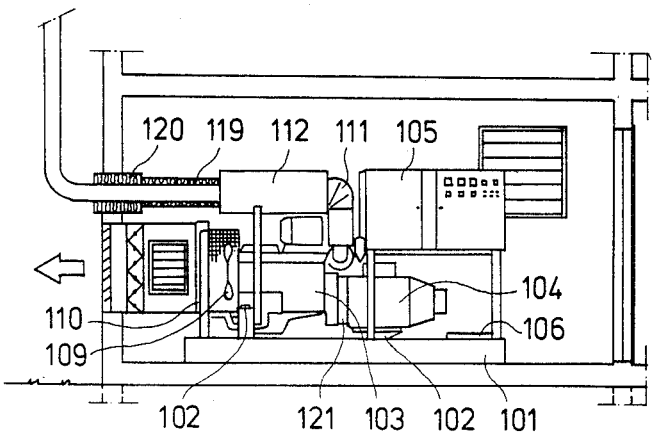
FIG. 1A PRIOR ART
Figure 1B:
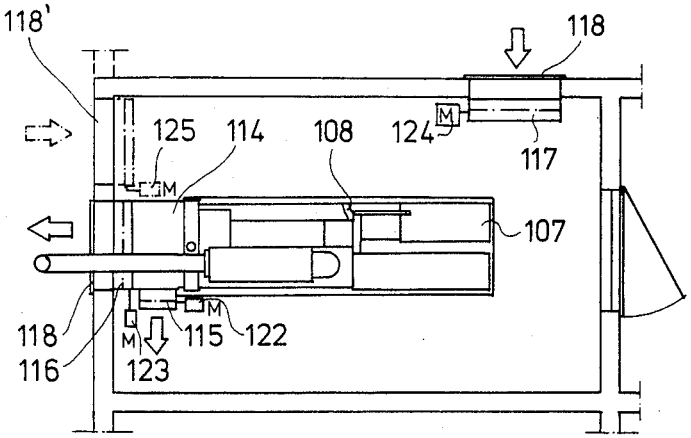
FIG. 1B PRIOR ART
FIG. 1B is a top plan view of the assembly illustrated in FIG. 1A.

A conventional engine driven generator assembly situated in an engine room is illustrated in FIGS. 1A and 1B, the assembly comprises a unitary steel base plate 101 on which a diesel engine 103 and a generator 104 are mounted laterally adjacent to each other with vibration blocks 102 being interposed between the engine and generator respectively and the base plate 101. The engine and generator are interconnected by power transmission means in the form of an elastic coupling and reduction gears 121. Control and monitoring instrumentation 105 are also mounted on base plate 101 as are storage batteries 106 required for starting the engine 103, a fuel tank 107 for the engine, and a pump 108 for filling the fuel tank. A radiator 110 is situated in front of the engine 103 and a fan 109 is provided between the radiator 110 and the engine 103 for blowing exhaust air out through an exhaust port. The exhaust gases from engine 103 are conducted through a flexible bellows tube 111 preferably enclosed within detachable heat insulation means, through a thermally insulated exhaust pipe 119, and finally through a thermally insulated tube 120 which passes through the wall of the engine room. An exhaust air duct 114 provided with a return air damper 115 is situated in front of the radiator 110. An exhaust air shut-off damper 116 is provided in front of the exhaust air duct 114 and communicates with a louver 118 situated in the wall of the engine room. The return air damper 115 and the exhaust air shut-off damper 116 are controlled by motors 122 and 123 in a manner such that when the temperature in the engine room is below normal operating temperature, the exhaust air shut-off damper 116 is closed and the return air damper 115 is opened whereby the exhaust air only circulates within the engine room. When the temperature of the engine 103 reaches normal operating temperature, the exhaust air shut-off damper 116 opens and at the same time the return air damper 115 closes whereby the exhaust air is conducted out of the engine room.

The combustion air required by the engine 103 and the cooling air for the machinery is drawn through the inlet port which is provided with a fresh air shut-off damper 117 covered by a louver 118. The fresh air shut-off damper 117 may be controlled by a motor 124.

As seen from the foregoing, an engine driven generator assembly in accordance with conventional construction which is situated within an engine room requires three separate apertures communicating with the external atmosphere. One aperture is required for the exhaust pipe, one aperture is required for the intake air and one aperture is required for the exhaust air. The conventional assembly, although being relatively narrow, is relatively long and therefore requires a great deal of floor space in the engine room. Moreover, the conventional design illustrated in FIGS. 1A and 1B is quite noisy in operation since there is no provision for sound insulation, and generally operates at noise levels of about 100 dB which is so high as to limit the time which a worker can spend within the engine room. Although the conventional construction described above can be provided with acoustic insulation, such provisions increase the dimensions of the assembly even further thereby limiting the maintenance space available within the engine room.

Figure 2:
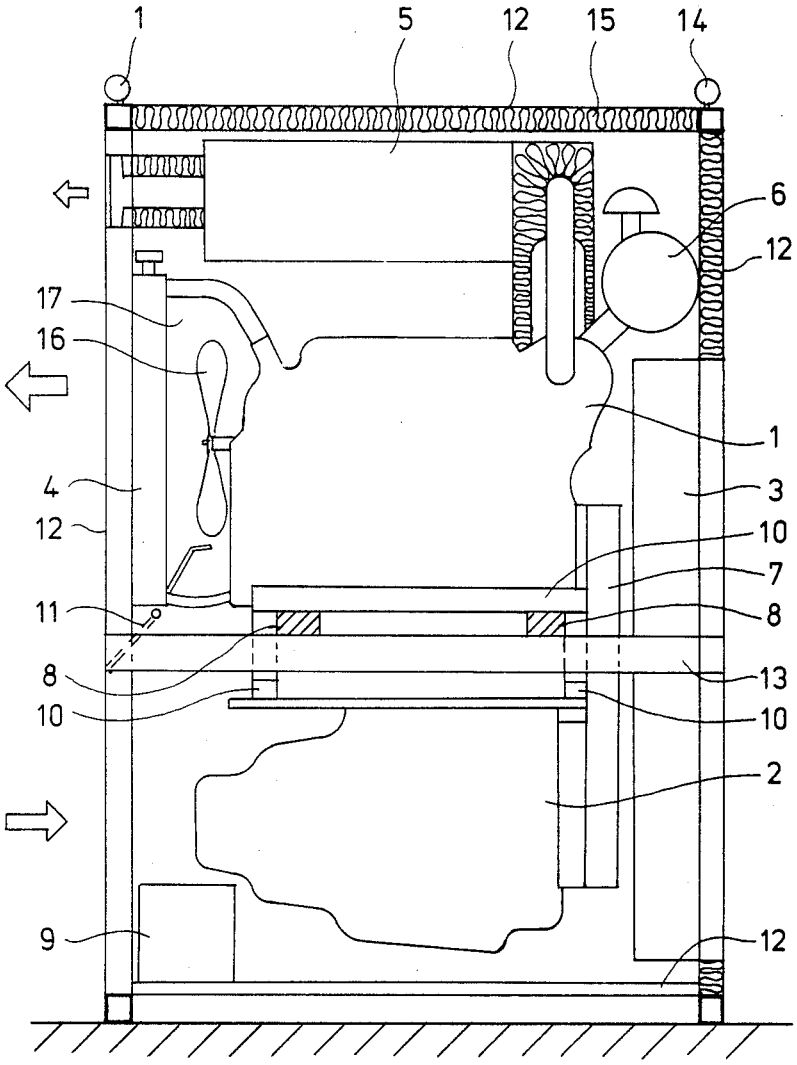
FIG. 2 is a side elevation view of an engine driven generator assembly constructed in accordance with the present invention shown without the ventilation module and with a side wall of the housing removed for purpose of clarity.

Referring now to FIG. 2 wherein an assembly constructed in accordance with the present invention is illustrated in elevational view without the ventilation module and with a housing side wall removed for purposes of clarity, a diesel engine 1 and a generator 2 are mounted within a housing including a substantially rigid frame formed of steel beams. The generator 2 and diesel engine 1 are mounted in the housing one above the other with the engine 1 being situated substantially vertically over the generator. The generator 2 is suspended from the engine 1 by means of connecting and supporting members 10 which rigidly fix the engine and generator to each other so that the alignment of the shafts as well as the distance between them are fixed and cannot change during operation. The generator 2 has substantially horizontal generator shaft and the diesel engine 1 has a substantially horizontal crankshaft which is situated substantially in the same vertical plane in which the generator shaft is situated. The unit formed by the engine 1 and generator 2 connected by members 10 is mounted on horizontal beams 13 of frame 12 with vibration blocks 8 being interposed therebetween. The mounting of the engine/generator unit on beams 13 is accomplished by means of the supporting members 10 which rest on the vibration blocks 8 and which are affixed to the sides of the engine 1. The supporting members 10 are fixed to the engine 1 at a point such that when the supporting members 10 are mounted on the vibration blocks 8 to suspend the engine/generator unit on the beams 13 of frame 12, the horizontal plane which passes through the points of support of the connecting members 10 on vibration blocks 8 substantially passes through the plane of the longitudinal axis of the engine/generator unit which passes through its center of gravity or at least sufficiently close thereto to thereby insure a stable installation of the engine/generator unit on frame 12.

The means for transmitting power from the engine 1 to the generator 2 is provided in the form of a toothed belt transmission 7. A toothed belt transmission is advantageous in that an appropriate transmission ratio as well as requisite flexibility can be achieved. A toothed belt also provides a slip-free positive drive as compared to a flat belt or the like, which is of particular importance in the controlling of the accuracy of power transmission. Although other power transmission means may be utilized, such as a V-belt drive whose tension is adjusted to be substantially slip-free or a hydrostatic transmission, a toothed belt transmission is preferred for the reasons discussed above.

A fuel tank 3 is disposed behind the engine 1 and generator 2 and is of a size which is sufficient to hold enough fuel for one day's operation. A conventional radiator 4 is situated in front of the engine 1 through which exhaust air from the equipment is blown by means of a blower 16. In the illustrated embodiment, a spring-loaded return air damper 11 is pivotally mounted beneath radiator 4 for directing the circulation of the exhaust air either out of the housing or into the inlet apertures thereof. Air guides 17 are also provided in conjunction with the radiator 4. Batteries 9 required for starting the engine 1 are also situated within the frame 12. Also mounted within frame 12 are a thermally insulated heavy duty noise suppressor 5 and an intake air filter 6 for the engine 1. Lifting loops 14 are detachably affixed to the outside of frame 12 at its upper corners by which the assembly can be moved such, for example, with a crane.

Figure 3:
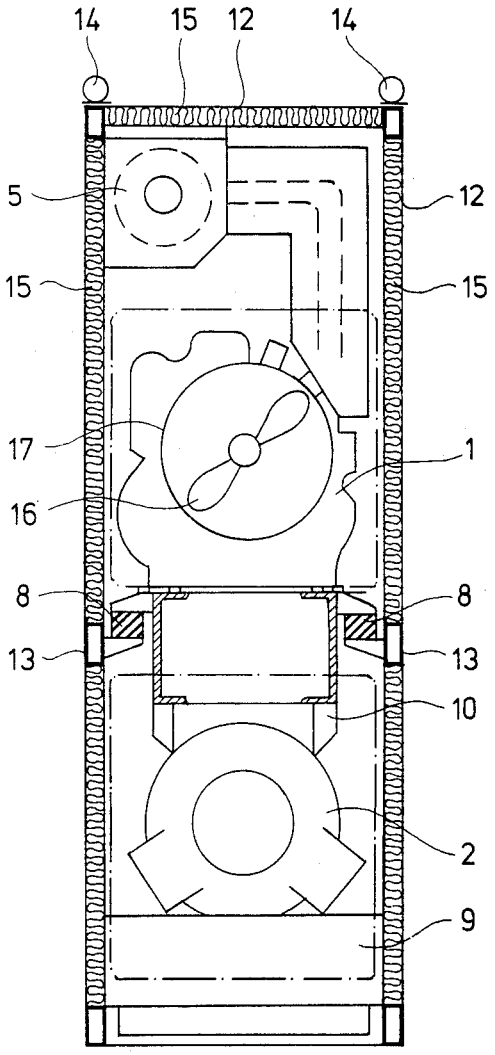
FIG. 3 is a front elevation view of the assembly illustrated in FIG. 2 with the front wall removed for purposes of clarity.

Referring to FIGS. 2 and 3, the assembly is provided with acoustic and thermal insulation 15 in the form of loose insulation elements which are attached to the assembly frame such, for example, as by threaded fasteners. The insulation elements are formed by an outer steel sheet, an inner perforated sheet and insulating material situated therebetween. As seen in FIG. 2, the fuel tank 3 constitutes a part of the rear wall of the housing frame thereby providing lateral stiffening reinforcement therefor.

Through the arrangement of the assembly described above wherein the engine 1 is situated vertically over the generator 2, an advantageous air circulation through the apparatus is obtained. Cold intake air is drawn into the housing at its lower end and thus initially flows over the generator 2. On the other hand, the heated exhaust air is discharged from the housing at its upper end through the engine 1. It is more advantageous to draw cold air initially over the generator 2 since the operating temperature of the generator generally should not exceed 40° C. Under such conditions there is no reason to increase the size of the generator and a smaller generator will be sufficient for a particular job. Since the heated exhaust air is conducted out of the housing at its upper end remote from the position where the cold intake air is admitted, the intake and exhaust air will not readily mix with each other since warm exhaust air will tend to rise.

By situating the diesel engine 1 at a higher elevation than the generator 2, an additional advantage is obtained that in that the engine is situated in a raised position making it easy to service. In this connection, it is noted that there is virtually no need to service the generator. As seen in FIG. 3, the breadth of the assembly is quite small and the height of the assembly is well within the limits of the height of a normal room. Although the dimensions are of course somewhat dependent upon the size of the engine and generator required for a particular application, within a normal power range for which an assembly of the type disclosed herein is intended, e.g., electric power output requirements of up to 200 kW, the dimensional variations are relatively minimal.

According to a feature of the invention, the breadth and height of the assembly can be selected such that it can be installed through the opening of a standard door, advantageously through a fireproof door, and most advantageously through a fireproof door with modular dimensions of 10 m by 21 m. Such a fireproof door is in normal use in buildings and the opening of such a door has a width of 830 mm and a height of 1940 mm. The breadth of the assembly is therefore most advantageously in the range of between about 650 to 1000 mm while the height of the assembly is preferably in the range of between about 1700 to 2100 mm. Preferably, the breadth of the assembly is in the range of between about 750 to 850 mm while the height is in the range of between about 1800 to 2000 mm. most preferably, the breadth of the assembly is about 810 mm while its height is about 1900 mm. An assembly of this size is capable of fitting through the opening of a fireproof door of the type described above. It is therefore not necessary to provide special openings in the walls of the engine room in order to install the assembly therein.

The length of the assembly depends upon the type of engine used for the power source. Clearly, a six cylinder engine will require more space than a four cylinder engine. The length of a typical assembly will vary in the range of between about 1580 to 2600 mm.

Figure 4A:
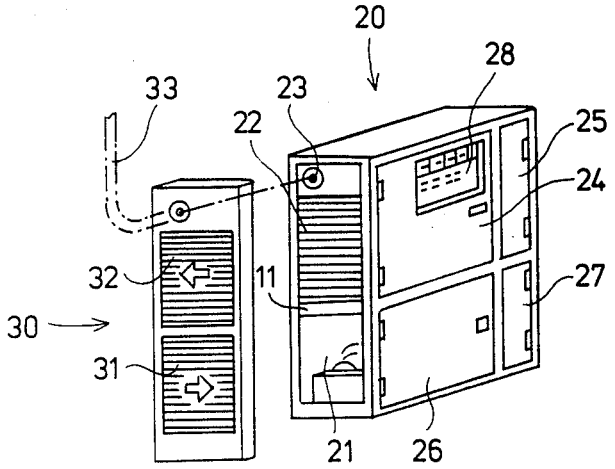
FIG. 4A is an axonometric view of an engine driven generator assembly in accordance with the invention and a ventilation module for connection thereto.
Figure 4B:
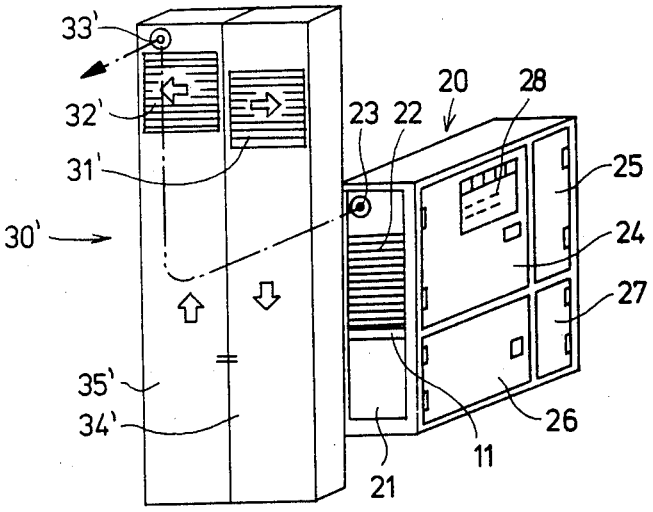
FIG. 4B is a view similar to FIG. 4A illustrating another design for a ventilation module.

Referring to FIGS. 4A and 4B, an engine driven generator assembly 20 in accordance with the invention is illustrated in conjunction with a ventilation module 30 (FIG. 4A) or 30' (FIG. 4B) adapted to be connected thereto. The construction illustrated in FIG. 4A is suitable, for example, when the engine room is located on the ground floor of the building. The assembly 20 is covered on all sides with sound and heat insulating elements. The front wall of the assembly 20 facing the ventilation module 30 is provided with a lower intake air aperture 21, an exhaust air aperture 22 situated above the air intake aperture 21 and an aperture 23 adapted to receive an exhaust pipe, the aperture 23 being situated above the exhaust air aperture 22.

Figure 8:
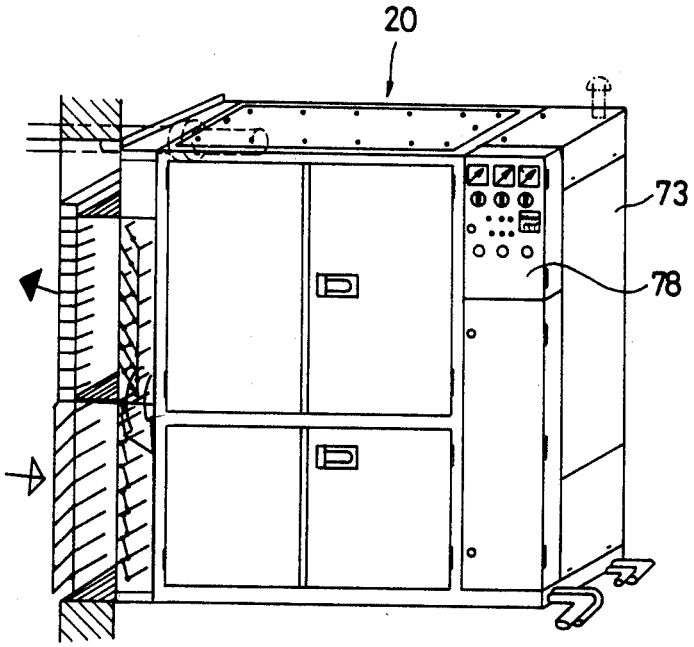
FIG. 8 is an axonometric view of another embodiment of an assembly in accordance with the invention and illustrating an alternative positioning of the meter and control panel.

Hinged doors 24, 25, 26 and 27 are provided on the side of the assembly 20 from which the apparatus will be serviced. The doors are structurally similar to the other housing walls in that they are provided with thermal and acoustical insulation. In the illustrated embodiment, the meter and control panel 28 which monitors and controls the operation of the engine 1 and generator 2 is installed in the door 24. The meter and control panel 28 swings out along with the door 24 when the latter is opened. It is understood that the meter and control panel may be situated elsewhere on the assembly housing, such as is shown in FIG. 8, or even within the housing. The side of the assembly 20 opposite from the illustrated servicing side is provided with detachable, non-hinged, elements attached to the supporting frame 12 such, for example, as by threaded fasteners. The wall forming elements may also be provided with lifting handles to facilitate removal.

As noted above, a return air damper 11 is situated between the air inlet port 21 and the exhaust port 22 by means of which the direction of the exhaust air can be controlled. The ventilation module 30 includes an air intake aperture 31, exhaust air aperture 32 situated above the air intake aperture 31, and a fitting for connection to an exhaust pipe fitted in the aperture 23. The ventilation module 30 is adapted to fit directly on the front wall of the assembly 20 without any particular modification thereof.

Referring to FIG. 4B, the assembly 20 is identical to that illustrated in FIG. 4A described above. The ventilation module 30' differs from module 30 of FIG. 4A in that in addition to the intake and exhaust air apertures 31' and 32', module 30' includes air passages 34' and 35' which direct supply air to the intake air aperture 31' and direct exhaust air from exhaust air aperture 32' respectively. The ventilation module 30' is particularly useful when the engine driven generator assembly is situated, for example, in a basement where it is necessary to obtain supply air and discharge exhaust air from and to remote areas. The ventilation module 30 illustrated in FIG. 4A is dimensioned so that it can be installed in the opening of a modularly dimensioned fireproof door of the type described above.

Figure 5:
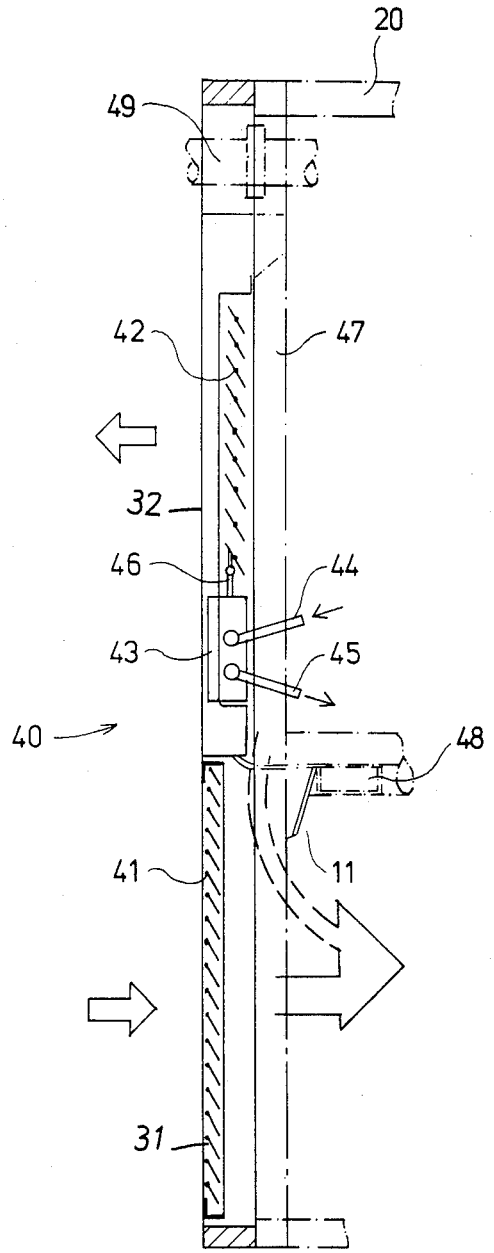
FIG. 5 is a side elevation view in section on an enlarged scale of a ventilation module for use in an assembly in accordance with the present invention.

Details of the construction of a ventilation module 40 are illustrated in FIG. 5. As noted above, the ventilation module comprises a unit having a cooling air intake aperture 31 located at its lower end, an exhaust air aperture 32 situated over intake air aperture 31 and a fitting 49 for connection to an exhaust pipe mounted in the exhaust pipe aperture of the assembly housing. A louver 41 is situated in the intake air aperture 31. Louver 41 preferably comprises a gravity-operated assembly which is closed when the assembly is not operating and which opens when operation is initiated under the effect of supply air being drawn through intake aperture 31 into the housing through the intake aperture 21 (FIG. 4A) provided therein. The exhaust air aperture 32 is also provided with a louver 42. The louver 42 is arranged to automatically open and close in accordance with the operating temperature of the diesel engine. In particular, suitable louver control apparatus are provided for closing the louver 42 when the diesel engine is cold and for opening the louver 42 to a fully opened position when the engine is at its normal operating temperature. In the illustrated embodiment, the louver 42 is opened and closed by means of an actuator 43 which is supplied with circulating cooling fluid from the diesel engine which enters the actuator 43 through a pipe 44 and which is conducted from the actuator 43 by pipe 45. The actuator 43 may, for example, constitute a vessel containing a cartridge formed of material which expands or contracts in accordance with the temperature of the cooling fluid. The expansion or contraction of the cartridge moves a rod 46 which engages the louver 42 whereby the latter opens and closes in accordance with the motion of rod 46.

As described above, a return air damper 11 is hinged to the generator assembly 20 either beneath the radiator 4 (FIG. 2) or on a transversely extending horizontal frame beam 48 (FIG. 5). Return air damper 11 is loaded by a spring which normally maintains the damper in a closed position indicated in phantom in FIG. 5. When the damper moves to its open position as seen in FIG. 5, an air flow path is opened from the exhaust air port of assembly 20 to the intake air port.

When the diesel engine is initially started, its temperature is low and louver 42 is closed under the action of actuator 43. However the engine fan 16 (FIG. 2) blows air against louver 42 so that in the free space 47 situated between the exhaust air louver 42 and the engine radiator 4 a static over-pressure is produced by the effect of which the return air damper 11 is opened against the force of its spring. Exhaust air then flows past damper 11 and mixes with the cold intake air entering through aperture 31 of module 40 and intake port 21 of the generator assembly 20. The warm exhaust air mixing with the cooler intake air causes the engine to warm up in a shorter time than it would have otherwise. As the engine temperature rises, the louver 42 begins to open under the action of actuator 43 whereby the static pressure in the space 47 is reduced allowing part of the exhaust air to flow out of the housing through the partially open louver 42 while a portion of the exhaust air will still flow past the return air damper 11. When the engine reaches normal operating temperature, the louver 42 is completely opened and the static pressure in space 47 becomes so small that the string of the return air damper 11 causes the damper to move to its fully closed position whereby all of the exhaust air will then flow out of the assembly housing through the louver 42. The louver 42 is arranged so that it directs the exhaust air in a slightly upward direction in order to minimize the possibility of exhaust air mixing with the incoming intake air. Of course, the possibility of such mixing is also decreased due to the fact that the warmer exhaust air will tend to rise.

Figure 6:
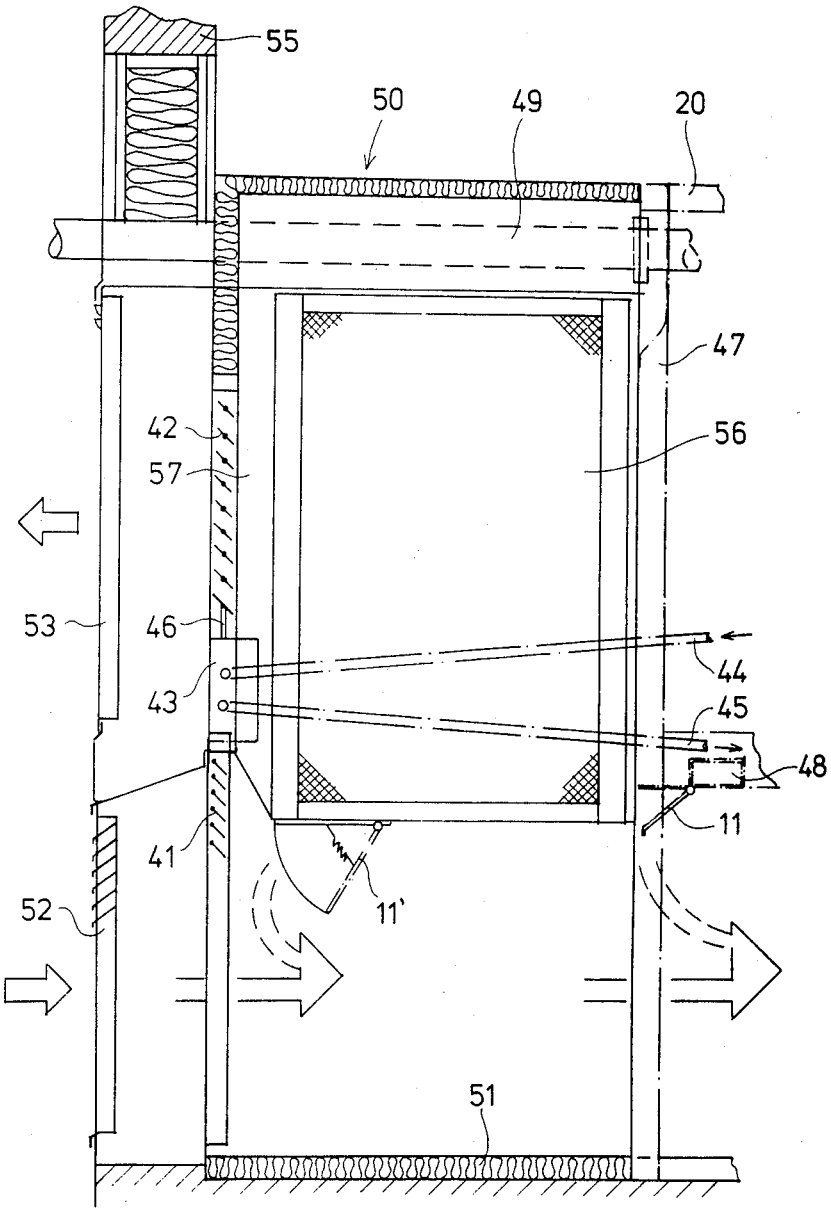
FIG. 6 is another embodiment of a ventilation module which is provided with noise suppression means.

Referring to FIG. 6, another embodiment of a ventilation module 50 in accordance with the invention is illustrated. Ventilation module 50 is provided with a noise suppressor in the form of a so-called noise trap. Those parts of ventilation module 50 which correspond to similar parts of the ventilation module 40 illustrated in FIG. 5 are designated by identical reference numerals. The noise trap 56 is situated between the exhaust air louver 42 and the generator assembly 20. Therefore, module 50 has a considerably greater length than module 40. The extent to which the length of module 50 exceeds that of module 40 depends upon the requirements for damping the sound generated by the discharging exhaust air. While the length of the module 40 is only about 80 mm, the length of module 50 will generally be in the range of between about 400 to 800 mm, depending upon the need for acoustic insulation. If the generator assembly is used with ventilation module 50 within an engine room, the engine room must naturally be correspondingly larger than in the case where the generator assembly is used with a smaller ventilation module, such as module 40.

When a ventilation module of the type illustrated in FIG. 6 is used, it is possible to mount the return air damper 11 in one of two alternative locations. The return air damper 11 may be situated prior to the noise trap 56 in which case its location, operation and construction are the same as described above in connection with FIG. 5. If the generator assembly is used in a cold climate where the gravity operated louver 41 in the intake air aperture may tend to freeze, the return air damper may be situated as illustrated at 11' so that the return air can at least partially be directed towards louver 41 to heat the same. Water may tend to accumulate during operation of the ventilation module 50 and for this reason the bottom 51 of the module 50 is preferably provided with an outwardly sloping inclination so that any water that may accumulate will run out through an opening situated below the air intake aperture.

The assembly illustrated in FIG. 6 is shown as being mounted in an aperture in the wall 55 which, for example, may constitute the opening of the fireproof door mentioned above. This opening may be provided with louvers 52 and 53 which communicate with the intake and exhaust apertures and which are situated flush with the outer wall surface.

Figure 7A:
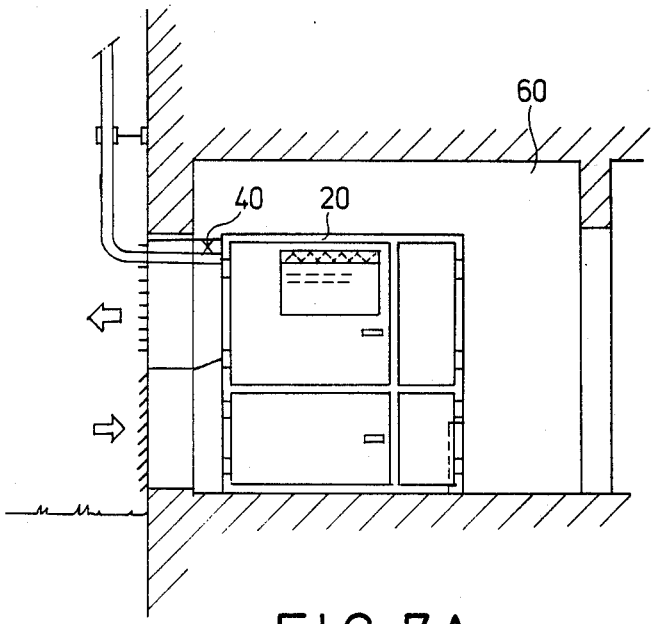
FIG. 7A is a side elevation view in partial section of an engine driven generator assembly in accordance with the present invention shown situated within an engine room.
Figure 7B:
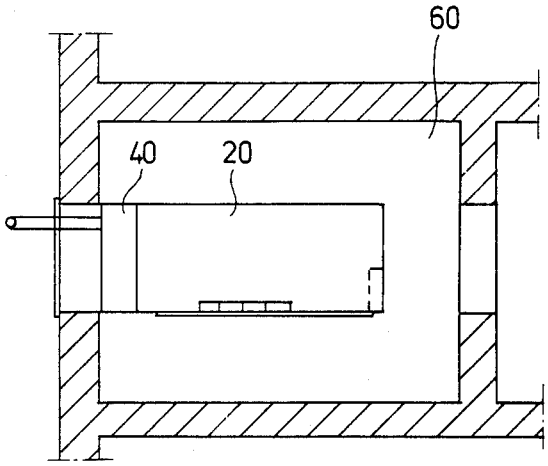
FIG. 7B is a top plan view of the assembly illustrated in FIG. 7A.

Referring to FIGS. 7A and 7B, the diesel generator of the invention is shown situated within an engine room 60. The apparatus is illustrated in FIG. 7A as viewed from the side of the diesel generator assembly 20 at which servicing is performed, i.e., from the side in which the hinged doors are mounted. This construction is illustrated in top plan view in FIG. 7B. As seen in the figures, the space requirements for the diesel engine assembly in the engine room are minimized. The generator assembly 20 requires a space of only about 800 mm on the side at which the opening doors are situated and of only about 500 mm on the opposite side and at the rear side. The ventilation module 40 is illustrated in FIGS. 7A and 7B situated against the front wall of the housing of assembly 20 and within the confines of the engine room walls. However, it is understood from the foregoing that the module 40 may extend through the door of the engine room or may be placed in an aperture formed in the engine room wall. Such positioning is particularly feasible when there is no requirement for a sound trap of the type illustrated in FIG. 6. Another embodiment of the invention is shown in an axonometric view in FIG. 8. The construction of the generator assembly 20 is similar to the construction of the assembly described above except that in this embodiment the meter and control panel 78 of the assembly is situated at the rear of the assembly adjacent to the fuel tank 73. As seen in FIG. 8, the meter and control panel 78 is quite narrow so that the fuel tank 73 can have a sufficient width. According to the embodiment of FIG. 8, it is possible to provide a simpler arrangement for conducting the wiring and cables from and to the assembly since the meter panel 78 does not swing out with the servicing door as in previously described embodiments, such movement of the panel not bein required for servicing the assembly.

It has been found in trial runs that have been carried out using the construction of the invention described hereinabove that the noise generated during operation of the generator assembly is significantly reduced as compared to conventional arrangements. The noise measured in the engine room with the diesel generator assembly running was about 78 dB which is to be compared with a noise level on the order of magnitude of about 100 dB which occurs during running of conventional arrangements.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. An internal combustion engine driven generator assembly, comprising:

a thermally and acoustically insulated housing including a substantially rigid frame to which insulation elements are attached, said frame and insulation elements constituting housing walls;

a generator mounted in said housing, said generator having a substantially horizontal generator shaft;

an internal combustion engine mounted in said housing substantially vertically over said generator, said engine having a substantiall horizontal crankshaft situated substantially in the same vertical plane in which said generator shaft is situated;

said generator and engine being suspended from said housing frame;

a fuel tank for said engine, said fuel tank constituting at least a part of a wall of said housing for providing lateral stiffening reinforcement therefor;

an intake air port, an exhaust air port and an aperture adapted to receive an exhaust pipe, said air ports and exhaust pipe aperture being provided in a common housing wall, said intake air port being situated below said exhaust air port and said exhaust air port being situated below said exhaust pipe aperture; and a ventilation module adapted to be mounted in said common housing wall in which said air ports and exhaust pipe aperture are formed, said ventilation module including apertures formed therein through which intake and exhaust air ar adapted to pass respectively, louver means for opening and closing said apertures, and a fitting for connection to an exhaust pipe mounted in said exhaust pipe aperture.

2. The combination of claim 1 wherein said ventilation module includes means for automatically selectively directing the circulation of exhaust air either directly through said exhaust air aperture of said ventilation module or at least partly towards said intake air port of said housing depending on the operating temperature of said engine.

3. The combination of claim 2 wherein said housing in which said engine and generator are mounted and said ventilation module mounted thereto are smaller than respective dimensions of a fireproof door so as to be capable of installation through an opening therefor.

4. The combination of claim 1 wherein said housing frame includes at least one substantially horizontal beam, said engine being mounted on said at least one beam, said generator being suspended from said engine by substantially rigid connection members, whereby said generator shaft and engine crankshaft are separated by a substantially constant distance.

5. The combination of claim 4 further including elastic vibration isolation elements being interposed between said engine and said at least one horizontal beam.

6. The combination of claim 4 wherein said engine is mounted on said at least one beam at a point situated in a horizontal plane which substantially passes through the center of gravity of said engine and said generator whereby a stable mounting of said engine and generator in said housing is obtained.

7. The combination of claim 1 wherein said housing and ventilation module mounted thereon has a width in the range of between about 650 to 1000 mm and a height in the range of between about 1700 to 2100 mm.

8. The combination of claim 1 wherein said housing and ventilation module mounted thereon has a width in the range of between about 750 to 850 mm and a height in the range of between about 1800 to 2000 mm.

9. The combination of claim 1 wherein said housing and ventilation module mounted thereon has a width of about 810 mm and a height of about 1900 mm so that said housing and ventilation module are capable of installation through an opening for a fireproof door having a width of about 830 mm and a height of about 1940 mm.

10. The combination of claim 1 wherein said ventilation module further comprises first noise trap means situated at said exhaust air aperture for reducing the noise level at said exhaust air aperture.

11. The combination of claim 10 wherein said ventilation module further comprises second noise trap means situated at said intake air aperture for reducing the noise level at said intake air aperture.

12. The combination of claim 1 further including means for coupling said engine crankshaft and generator shaft to each other for transmitting power from said engine to said generator, said power transmission means including a toothed endless belt.

13. The combination of claim 1 further including means for coupling said engine crankshaft and generator shaft to each other for transmitting power from said engine to said generator, said power transmission means including an endless V-belt.

14. The combination of claim 1 further including means for coupling said engine crankshaft and generator shaft to each other for transmitting power from said engine to said generator, said power transmission means including hydrostatic coupling means.

* * * * *